US009806405B2

(12) United States Patent
Fahlbusch et al.

(10) Patent No.: US 9,806,405 B2
(45) Date of Patent: Oct. 31, 2017

(54) INTEGRATED CIRCUIT FOR REMOTE KEYLESS ENTRY SYSTEM

(71) Applicant: Atmel Corporation, San Jose, CA (US)

(72) Inventors: Thorsten Fahlbusch, Heilbronn (DE); Marco Schwarzmueller, Heilbronn (DE); Juergen Schnabel, Leingarten (DE)

(73) Assignee: Atmel Corporation, San Jose, CA (US)

( * ) Notice: Subject to any disclaimer, the term of this patent is extended or adjusted under 35 U.S.C. 154(b) by 790 days.

(21) Appl. No.: 13/756,484

(22) Filed: Jan. 31, 2013

(65) Prior Publication Data

US 2014/0210677 A1 Jul. 31, 2014

(51) Int. Cl.
*H01Q 1/32* (2006.01)
*H01Q 5/50* (2015.01)

(52) U.S. Cl.
CPC ..... *H01Q 1/3241* (2013.01); *H01Q 5/50* (2015.01)

(58) Field of Classification Search
CPC ..... H03F 2200/504; H03F 1/0227; H03F 1/0238; H03F 1/0277; H03F 2200/511; H03F 3/24; H03G 3/004; H03G 3/3042; H01Q 5/50; H01Q 1/3241; H01Q 5/05; H04B 1/1607; H04B 1/406
See application file for complete search history.

(56) References Cited

U.S. PATENT DOCUMENTS 5,251,331 A * 10/1993 Schwent ..... H03G 3/3047 330/297
5,365,240 A * 11/1994 Harmuth ..... H01Q 17/001 327/108
5,420,536 A * 5/1995 Faulkner ..... H03C 3/406 330/129
5,546,051 A * 8/1996 Koizumi ..... H03F 1/0244 330/297
6,163,706 A * 12/2000 Rozenblit ..... H03F 1/0211 330/279
6,229,494 B1 * 5/2001 Merenda ..... H01Q 1/273 343/701
7,050,772 B2 * 5/2006 Herzberg ..... H04B 1/04 455/126

(Continued)

FOREIGN PATENT DOCUMENTS

FR 2755925 A1 * 5/1998 ..... B60R 25/20

*Primary Examiner* — Nay Tun
(74) *Attorney, Agent, or Firm* — Fish & Richardson P.C.

(57) ABSTRACT

An integrated circuit for use in remote keyless entry (RKE) applications is disclosed that integrates two drivers with a shared dual mode antenna. The drivers may be integrated on a single integrated circuit chip using high voltage (HV) complementary metal-oxide-semiconductor (CMOS) processes. In immobilizer mode of operation, an immobilizer driver coupled to the dual mode antenna is configured to drive the dual mode antenna, while an LF mode driver coupled to the dual mode antenna is configured to be idle. In LF mode of operation, the LF mode driver is configured to drive the dual mode antenna, while the immobilizer driver is configured to be idle. In some implementations, the drivers are coupled to a common node coupled to the dual mode antenna and are selectively biased with different supply voltages based on the current mode of operation to prevent current leakage and component damage.

20 Claims, 9 Drawing Sheets

(56) References Cited

U.S. PATENT DOCUMENTS

| | | | | |
|---|---|---|---|---|
| 7,245,180 | B2 * | 7/2007 | Earl | H03F 1/0205 330/133 |
| 7,366,483 | B2 * | 4/2008 | Liu | H03G 3/004 455/127.1 |
| 8,331,883 | B2 * | 12/2012 | Sorensen | H04B 1/1607 455/127.1 |
| 2005/0012593 | A1 * | 1/2005 | Harrod | B60R 25/04 340/5.72 |
| 2005/0212601 | A1 * | 9/2005 | Brandt | H03F 1/0261 330/285 |
| 2008/0064345 | A1 * | 3/2008 | Yoshida | G07C 9/00309 455/127.1 |
| 2008/0220826 | A1 * | 9/2008 | Dagher | H04W 52/52 455/572 |
| 2009/0160607 | A1 * | 6/2009 | Edwards | B60R 25/24 340/5.61 |
| 2013/0021099 | A1 * | 1/2013 | Berchtold | H03F 1/0238 330/254 |
| 2014/0085008 | A1 * | 3/2014 | Cohen | H03F 1/0227 330/297 |

* cited by examiner

INTEGRATED CIRCUIT FOR REMOTE KEYLESS ENTRY SYSTEM

TECHNICAL FIELD

This disclosure relates generally to integrated circuits for remote keyless entry (RKE) systems.

BACKGROUND

RKE systems have replaced the traditional mechanical ignition key as the standard for vehicle access applications. Conventional RKE systems use an ultra-high frequency (UHF) link from a key fob to the vehicle that triggers a lock/unlock mechanism in the vehicle in response to a user pushing a button on the key fob. In recent years, more advanced RKE systems, such as passive entry (PE) and passive entry go (PEG) have been introduced into vehicles. These advanced, second-generation RKE systems provide vehicle owners with easier access than first generation RKE systems. Contemporary PE and PEG systems may use radio-frequency identification (RFID) technology, which requires Low Frequency (LF) antennas to be distributed throughout the vehicle for use in unlocking doors, trunks, etc.

For many years, antitheft systems called "immobilizers" have been installed in vehicles. Many conventional immobilizer systems also use RFID technology. These conventional immobilizer systems include a reader antenna and other reader hardware in the vehicle that reads an RFID tag in the key fob. A successful read of an RFID tag releases an electronic immobilizer mechanism that prevents the engine of the vehicle from being started.

While immobilizer systems and contemporary RKE systems may use similar RFID techniques and frequencies, the two systems are often installed in vehicles as separate systems and do not share components.

SUMMARY

An integrated circuit for use in RKE applications is disclosed that integrates two drivers coupled to a shared dual mode antenna. The drivers may be integrated on a single integrated circuit chip using high voltage (HV) complementary metal-oxide-semiconductor (CMOS) processes. In immobilizer mode of operation, an immobilizer driver coupled to the dual mode antenna is configured to drive the dual mode antenna, while an LF mode driver coupled to the dual mode antenna is configured to be idle. In LF mode of operation, the LF mode driver is configured to drive the dual mode antenna, while the immobilizer driver is configured to be idle. In some implementations, the drivers are coupled to a common node coupled to the dual mode antenna and are selectively biased with different supply voltages based on the current mode of operation to prevent current leakage and component damage.

Particular implementations of the integrated driver for vehicle immobilizer/access applications provide one or more of the following advantages: 1) better cost efficiency by using a single LF antenna for both immobilizer and vehicle access systems instead of two separate antennas; 2) higher level of system integration achieved by using a single integrated circuit chip instead of two chips for the immobilizer and access systems; 3) relaxed limit for minimum car battery voltage by using a voltage booster stage during immobilizer operation; 4) lower number of components and thus lower overall bill of materials (BOM) for easier integration into a customer's system solution; 5) lower effort for logistics and stock keeping due to fewer components; and 6) reduced number of components for the overall system resulting in enhanced reliability.

DETAILED DESCRIPTION

Conventional Immobilizer and RKE Systems

Figure 1:
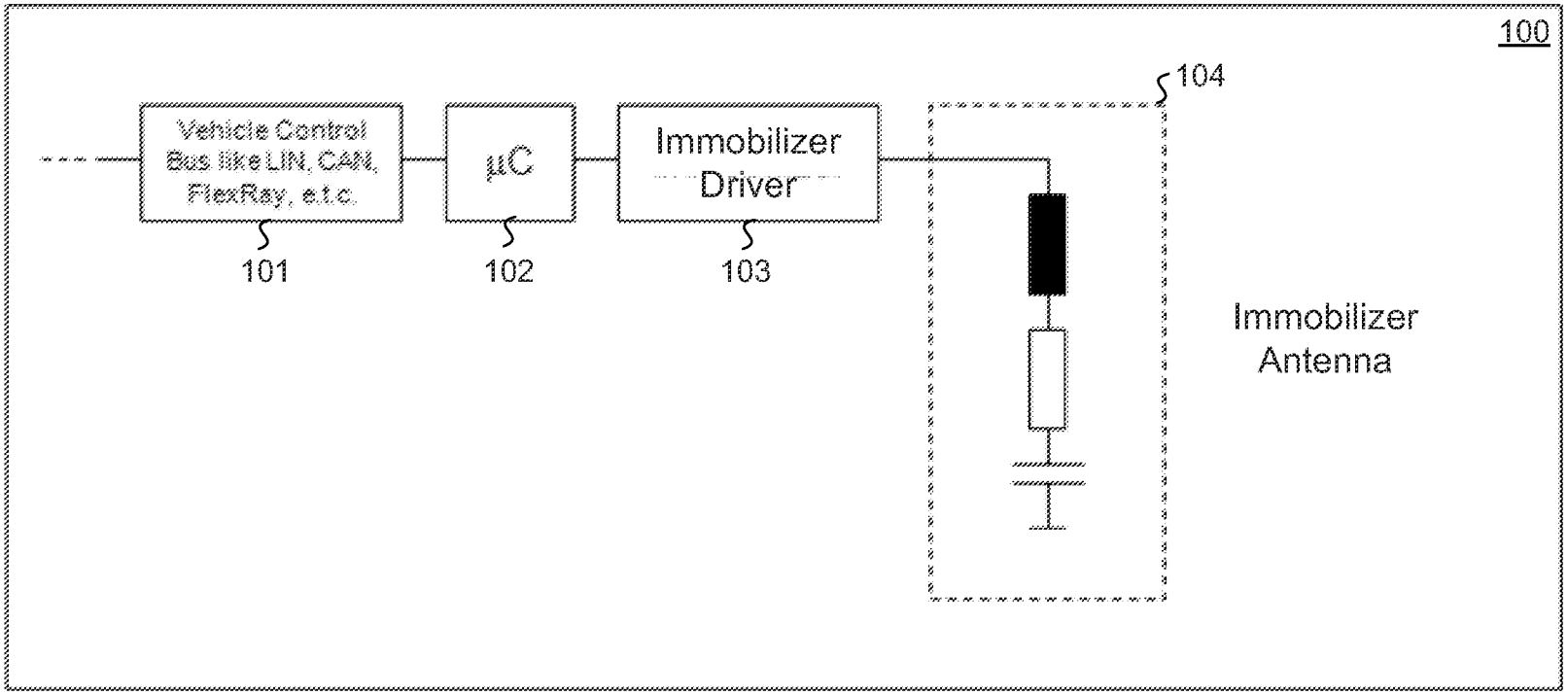
FIG. 1 (Prior Art)
FIG. 1 illustrates an example circuit configuration of a conventional vehicle immobilizer system.

FIG. 1 illustrates an example circuit configuration of a conventional immobilizer system 100. In some implementations, system 100 includes vehicle control bus 101, microcomputer 102, immobilizer driver 103 and immobilizer antenna 104. Vehicle control bus 101 can be any known bus system for vehicles, including but not limited to: local interconnect network (LIN), controller area network (CAN) and FlexRay™.

A microcircuit inside a passive key fob is activated by a small electromagnetic field generated by immobilizer antenna 104, which induces a current flow inside the key fob body, which in turn causes the microcircuit to broadcast a wireless signal carrying a unique binary code. The binary code is received by immobilizer antenna 104, which may be wrapped around the ignition barrel lock. Microcomputer 102 reads the code and checks for a match with a code stored in microcomputer 102. In some implementations, microcomputer 102 is part of a central board controller. In other implementations, microcomputer 102 is part of an automobile's Engine Control Unit (ECU). When microcomputer 102 determines that the code is current and valid, microcomputer 102 or the ECU activates a fuel-injection sequence so that the vehicle can be started.

Figure 2:
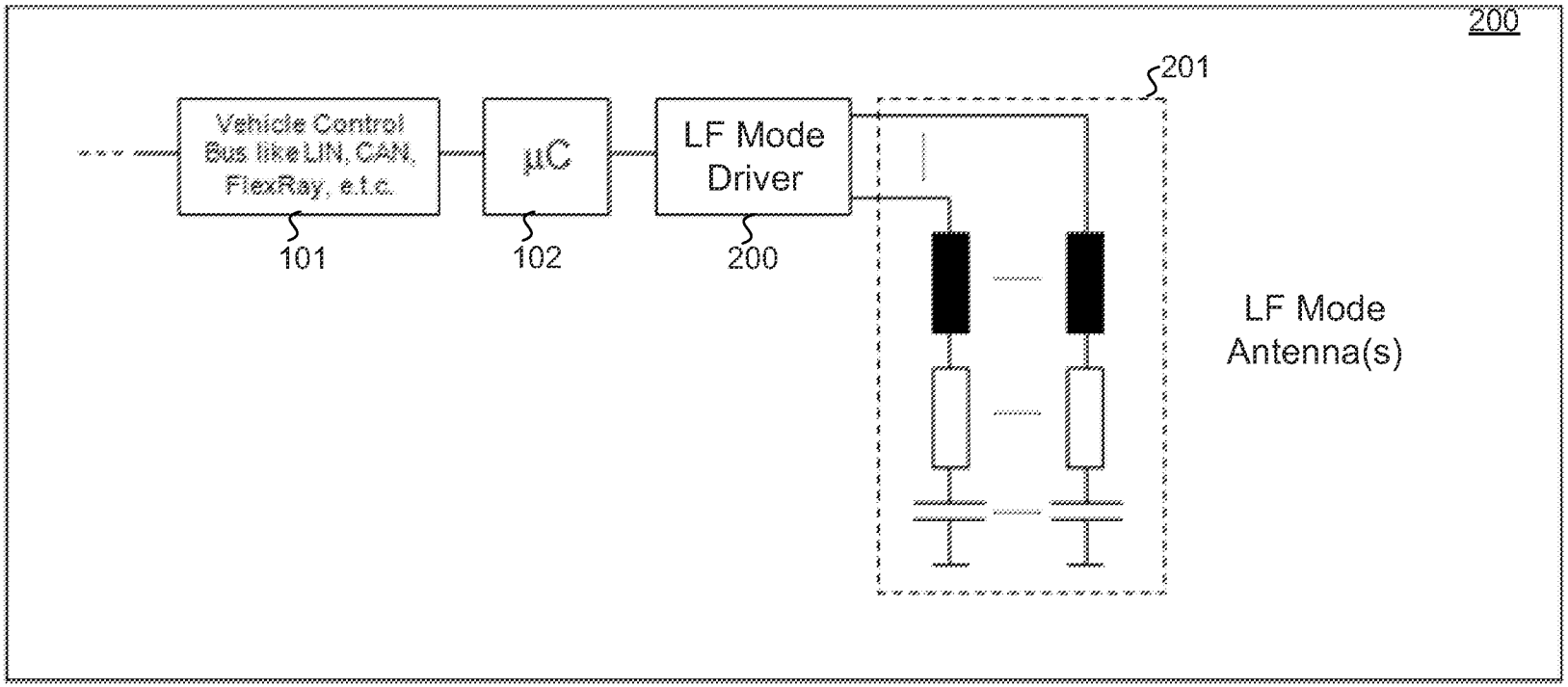
FIG. 2 (Prior Art)
FIG. 2 illustrates an example circuit configuration of a LF portion of a conventional RKE system.

FIG. 2 illustrates an example circuit configuration of a LF portion of a conventional RKE system. In some implementations, system 200 includes vehicle control bus 101, microcomputer 102, LF mode driver 200 and one or more LF antennas 201. LF antennas 201 may be placed in each door of the vehicle and are driven by LF mode driver 200, which is also located in the vehicle. When a user pulls a vehicle door handle a switch activates a request to a central board controller or ECU to establish LF communication over a LF downlink between the vehicle and the LF tag in the key fob. The LF tag in the key fob triggers the UHF transmitter in the key fob to transmit current and a valid code to the UHF receiver of the vehicle.

Typical vehicle installations include separate integrated circuits for driving separate antennas for engine immobilizer and RKE applications, resulting in a larger number of parts and the associated costs of those parts. As described below, a single integrated circuit includes two drivers coupled at a common node that is coupled to a shared "dual mode" antenna. The dual mode antenna is capable of being operated in one of two modes: immobilizer mode and LF mode. By sharing the same silicon and the same antenna, the number of parts of the overall system and associated cost for those parts are reduced.

Example Functional Blocks and Modes of Operation

Figure 3:
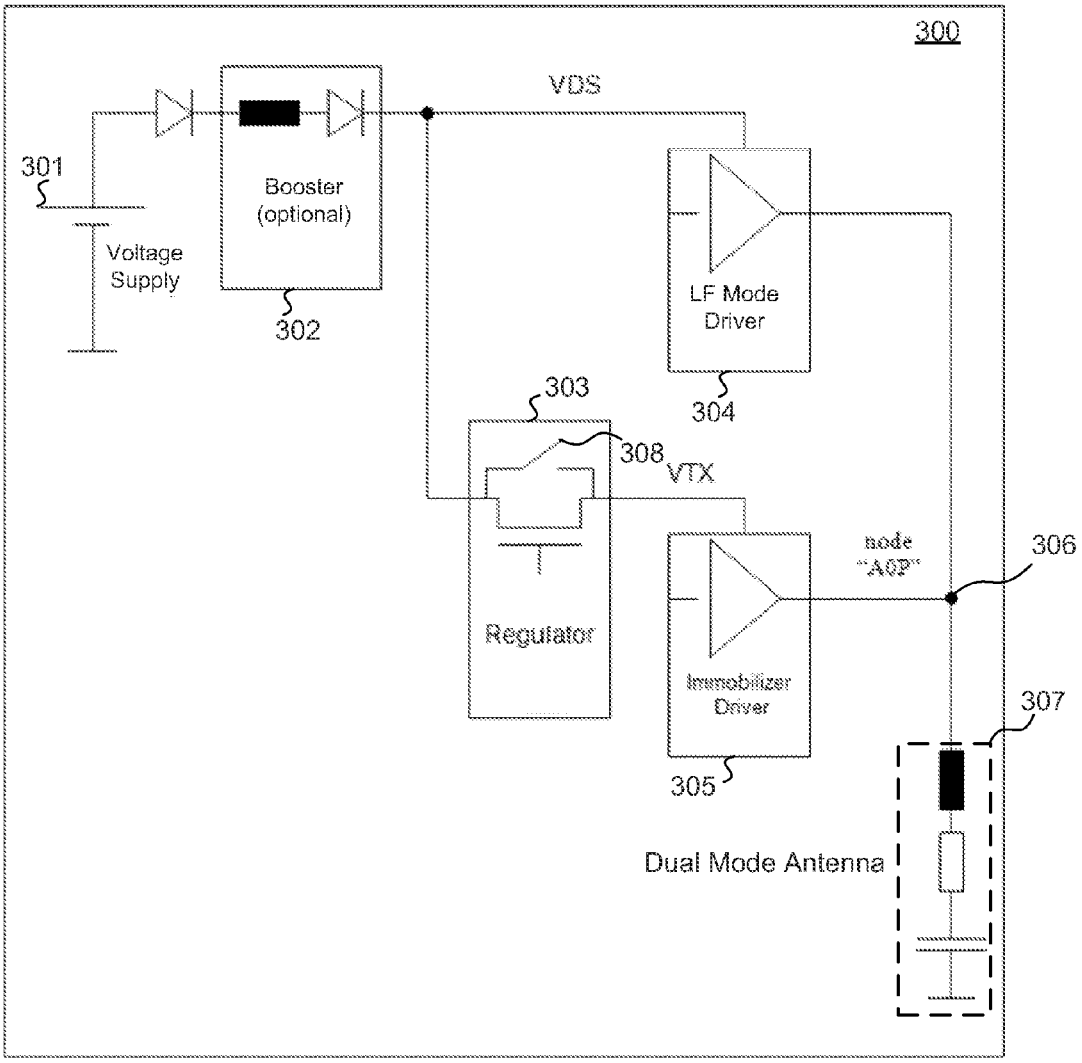
FIG. 3 illustrates an example circuit configuration including integrated drivers sharing a dual mode antenna.

FIG. 3 illustrates an example circuit configuration including integrated drivers sharing a dual mode antenna. In some implementations, circuit 300 includes voltage source 301 (e.g., a battery), booster 302, regulator 303, LF mode driver 304, immobilizer driver 305 and dual mode antenna 307. The outputs of LF mode driver 304 and immobilizer driver 305 are coupled to common node 306 (AOP). In some implementations, regulator 303 includes or is coupled to bypass switch 308.

Booster 302 is an optional component that is used during LF mode operation. Booster 302 is coupled to voltage source 301 and generates supply voltage VDS for LF mode driver 304 and immobilizer driver 305 (during LF mode operation). LF mode driver 304 needs voltages higher than voltage source 301 can provide to fulfill minimum voltage requirements for advanced RKE systems like PE and PEG. Optionally, booster 302 can also be used for immobilizer mode operation to overcome limitations imposed by minimum battery voltages. Booster 302 may be, for example, a DC-to-DC converter.

Regulator 303 is a voltage regulator for supply voltage VDS. Regulator 303 is coupled to supply voltage VDS and provides a stabilized, regulated supply voltage VTX to immobilizer driver 305 during immobilizer mode operation. Regulator 303 provides noise reduction for data transfer between reader hardware (not shown) and a transponder in the key fob. Regulator 303 also isolates the reader hardware and thus the reader channel from disturbances and spurious interferences coming from the vehicle's power supply grid, voltage source 301 or, in general, the VDS supply domain. Regulator 303 also provides noise reduction when booster 302 is active during immobilizer mode operation. In some implementations, a regulator can be used to regulate voltage VDS as well as VTX.

During LF mode, regulator 303 is bypassed (e.g., using bypass switch 308) to allow the VTX voltage supply pin of immobilizer driver 305 to be coupled directly to the VDS voltage domain. Bypass switch can be integrated into regulator 303 or coupled to regulator 303. Switch 308 may implemented using one or more transistors that are biased to operate as a switch.

LF mode driver 304 is configured to be active during LF mode operation. LF mode driver 304 is supplied by the boosted battery voltage VDS and outputs a modulated LF signal to dual mode antenna 307. When immobilizer mode is active, LF mode driver 304 is idle and its output is placed in a high ohmic state to prevent current leaking into LF mode driver 304 and damaging sensitive components in LF mode driver 304. To place the output of LF mode driver 304 in a high ohmic state the unregulated supply voltage VDS of LF mode driver 304 should be greater than or equal to the regulated voltage VTX input to immobilizer driver 305 (VDS≥VTX). This condition is fulfilled when bypass switch 308 of regulator 303 is opened.

During immobilizer mode operation, immobilizer driver 305 is configured to be active. The supply voltage for immobilizer 304 is the regulated VTX voltage output by regulator 303. During LF mode operation, the output of immobilizer driver 305 is placed into a high ohmic state to prevent current leaking into immobilizer driver 305 and damaging sensitive components in immobilizer driver 305. To place the output of immobilizer driver 305 in a high ohmic state, the supply voltage VTX of immobilizer driver 305 should be equal to the unregulated supply voltage VDS of LF mode driver 304 (VDS=VTX). This condition is fulfilled when bypass switch 308 of regulator 303 is closed, directly coupling VDS to immobilizer driver 305.

Dual mode antenna 307 is a shared LF antenna that is driven by immobilizer driver 305 during immobilizer mode operation and driven by LF mode driver 304 during LF mode operation. Dual mode antenna 307 may be coupled to LF mode driver 304 and immobilizer driver 305 at common node 306 (AOP).

In some implementations, circuit 300 can be configured to use differential signal chains for processing differential signals by replacing the components in circuit 300 with differential components.

Description of Modes of Operation

Immobilizer Mode

During immobilizer mode of operation, immobilizer driver 305 drives dual mode antenna 307, which generates a wireless signal that provides power to a transponder in a key fob and additionally carries a triggering signal that is expected by the transponder. When the transponder is activated by the power, the transponder responds to the triggering signal by generating a response carrier signal modulated with a code. The response carrier signal is received through dual mode antenna 307 and fed into reader hardware (not shown), where the code is demodulated and decoded if encoded and/or encrypted.

Under normal conditions, booster 302 is idle during immobilizer mode operation. This results in VDS=(voltage supply 301) minus two diode voltages, hereafter referred to as "immobilizer mode 1." One diode is part of booster 302 and one diode is a reverse polarity protection diode.

In some implementations, the configuration of FIG. 3 allows system architects to activate booster 302 during immobilizer mode operation to overcome the limitations of minimum battery voltages, hereafter referred to as "immobilizer mode 2."

During either immobilizer mode 1 or 2 operation, LF mode driver 304 is idle and its output is placed in a high ohmic state by providing supply voltage VDS to LF mode driver 304, such that during immobilizer mode operation the condition VDS≥VTX is satisfied. The high ohmic output state prevents current from leaking into LFS mode driver 304 and damaging internal transistors of LF mode driver 304.

During immobilizer mode operation, regulator 303 is active and generates from the VDS voltage at its input a regulated VTX voltage for immobilizer driver 305. The regulated VTX voltage is the supply voltage for immobilizer driver 305 when the system is in immobilizer mode operation. For proper operation of immobilizer driver 305, the regulated VTX voltage has to fulfill challenging requirements, which may be defined by sensitivity requirements of other hardware used in the immobilizer application, such as a wireless signal receiver in the reader hardware.

During immobilizer mode operation, dual mode antenna 307 is stimulated by a driving signal provided by immobilizer driver 305. Immobilizer driver 305 sends out a signal to a transponder in the key fob, which responds with a carrier signal modulated with a code (e.g., unique binary code). The response signal is received by dual mode antenna 307 and fed into reader hardware, where the code is demodulated from the carrier signal and decoded if encoded and/or encrypted.

LF Mode

The LF mode is the mode of operation for advanced RKE applications like PE and PEG. The LF mode of operation is used for the transmission of an LF signal expected by the key fob to trigger a system wake up procedure. During LF mode operation, booster 302 is active. When activated booster 302 steps voltage source 301 up to a voltage level VDS that is sufficient for proper operation of the RKE application and provides the VDS voltage as a voltage supply to LF mode driver 304. The input signal of LF mode driver 304 is amplified and fed into dual mode antenna 307.

During LF mode operation, regulator 303 is placed in a bypass mode. For example, switch 308 is closed, resulting in VTX=VDS. The bypass mode keeps the output of immobilizer driver 305 in a high ohmic state while maintaining bias conditions that avoid undesired leakage currents to enter immobilizer 305 due to the presence of a signal at common node 306.

During LF mode operation, dual mode antenna 307 is stimulated by a driving signal provided by LF mode driver 304. LF mode driver 305 causes dual mode antenna 307 to generate an electromagnetic field that can be detected by the key fob circuitry.

Example Biasing of Integrated Drivers

Figure 4:
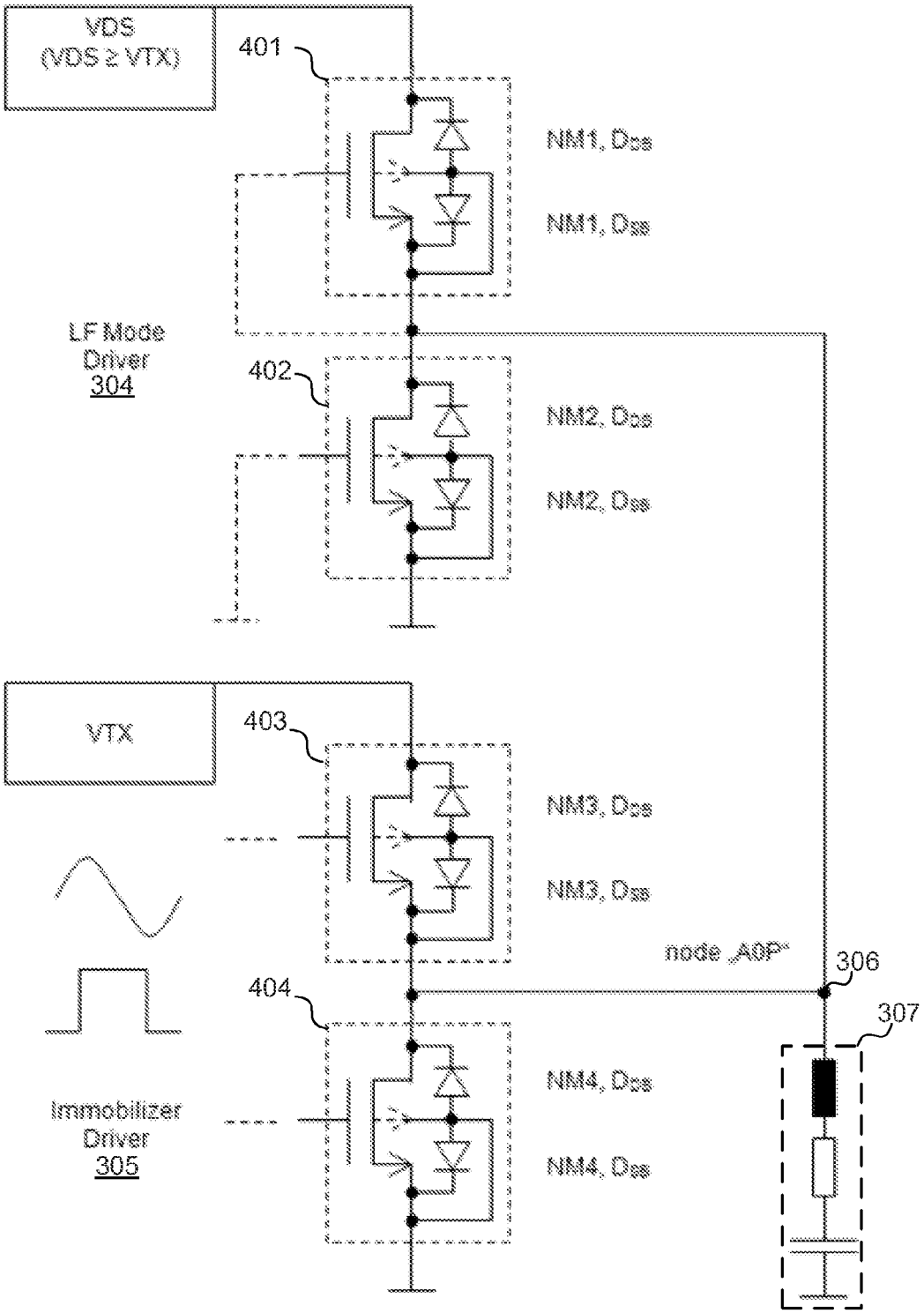
FIG. 4 illustrates an example circuit configuration for immobilizer mode.

FIG. 4 illustrates an example circuit configuration 400 for immobilizer mode. When immobilizer mode is selected, LF mode driver 304 is configured to be idle and immobilizer driver 305 (transistors 403 (NM3) and 404 (NM4)) is configured to drive dual mode antenna 307, generating a signal voltage in the range of VTX to ground (GND). The NMOS transistors 401 (NM1), 402 (NM2) of LF mode driver 304 are passive and configured to remain off even when the signal from immobilizer mode operation is present at common node 306. The gates of NMOS transistors 401-404 may be controlled by internal hardware (not shown).

A problem with the circuit configuration of FIG. 4 is that the parasitic diodes $D_{DB}$, $D_{SB}$ for NMOS transistors 401, 402, respectively, may become forward biased during immobilizer mode due to the signal present at common node 306, resulting in unintended currents being sent through LF mode driver 304. This problem is avoided by keeping the condition VDS≥VTX. This voltage condition causes parasitic diodes $D_{DB}$, $D_{SB}$ of transistors 401, 402 to be reverse biased, which prevents unintended currents from entering LF mode driver 304.

Figure 5:
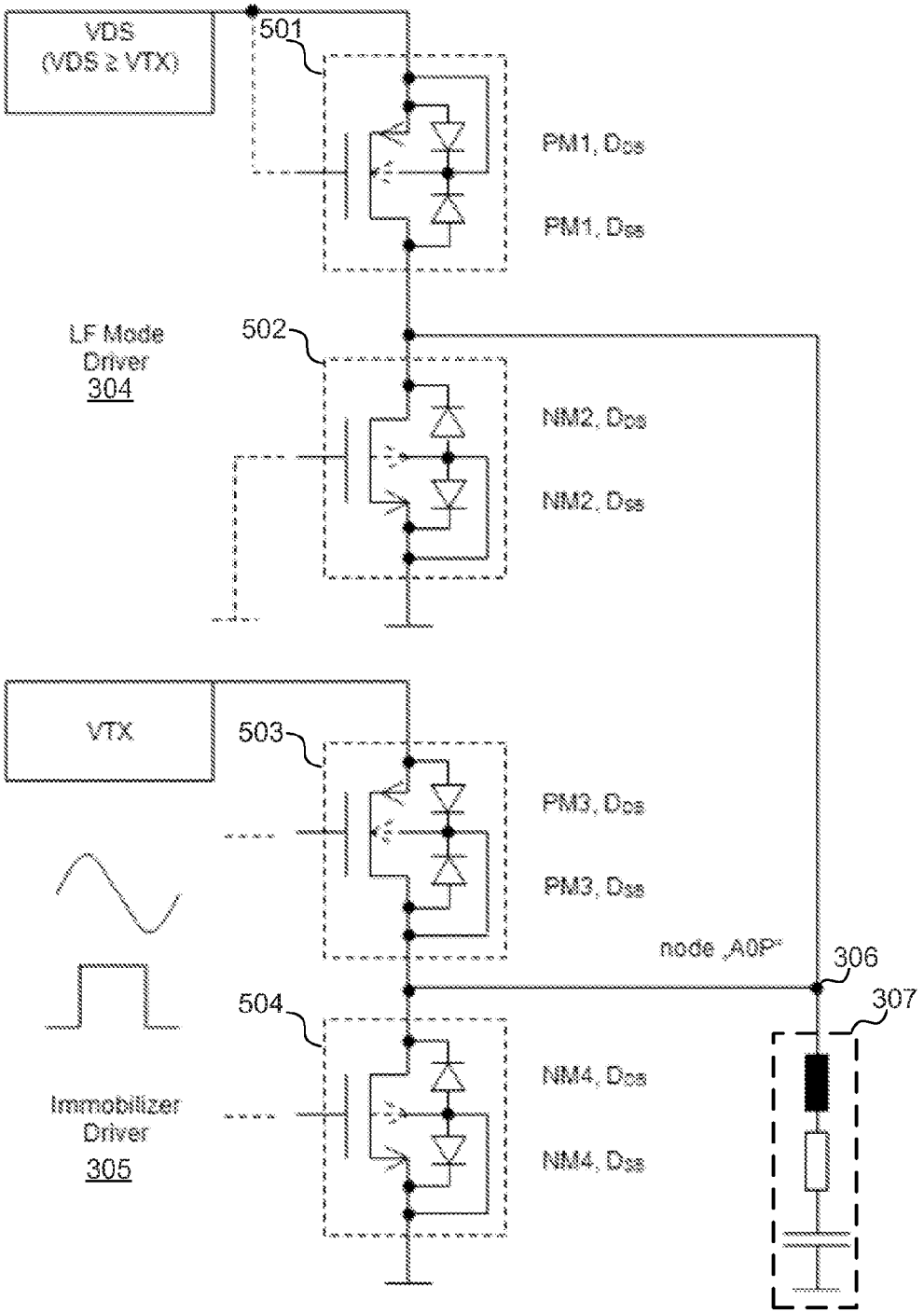
FIG. 5 illustrates an example circuit configuration for immobilizer mode using push-pull stages.

In some implementations, push-pull driver circuit configurations may be used by replacing NMOS transistors 401, 403 with PMOS transistors 501 (PM1), 503 (PM3), as shown in FIG. 5. The power management and bias conditions previously described in reference to the circuit shown in FIG. 4 are also applicable to the circuit shown in FIG. 5.

Figure 6:
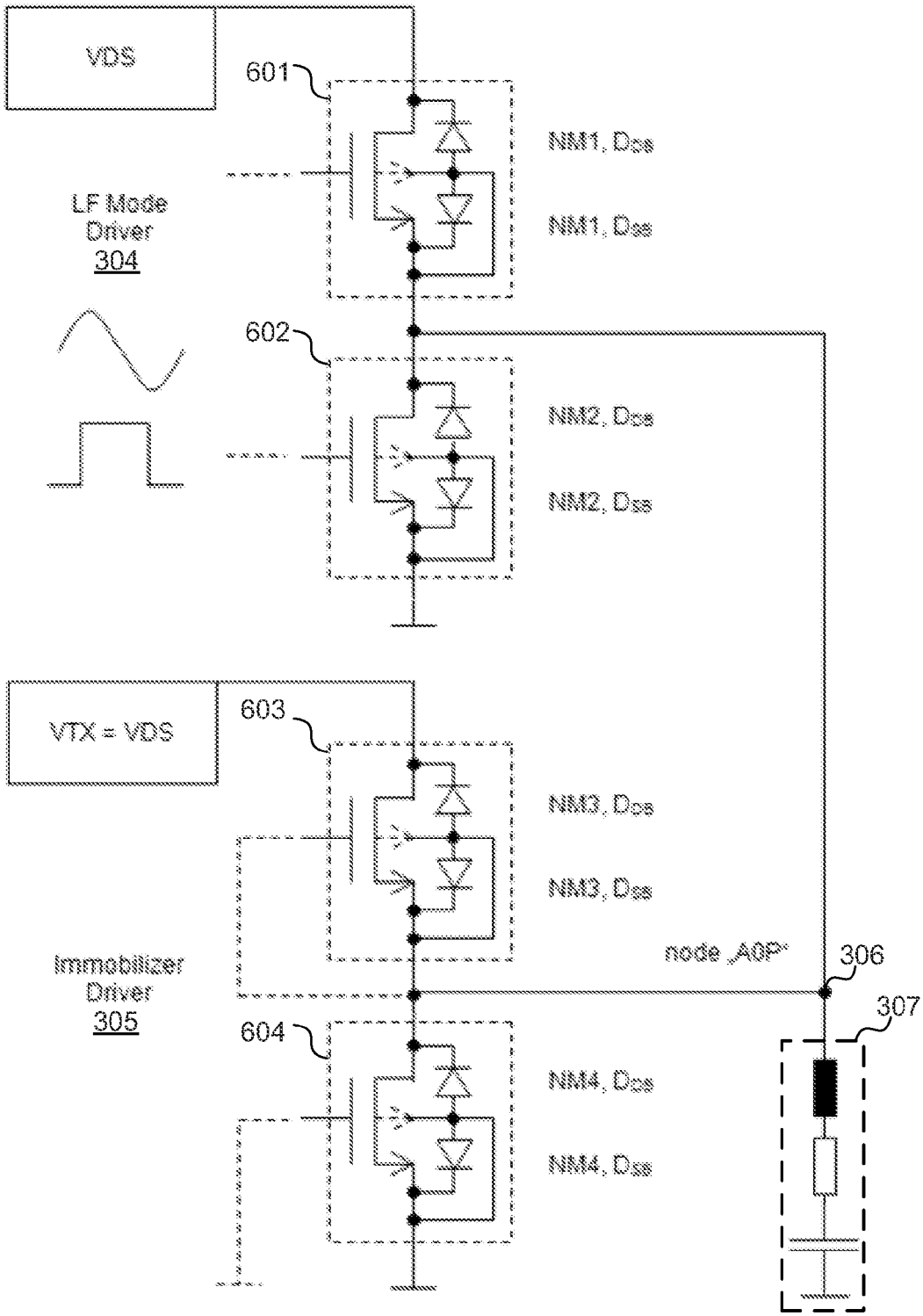
FIG. 6 illustrates an example circuit configuration for LF mode.

FIG. 6 illustrates a circuit configuration for LF mode of operation. When LF mode operation is selected, transistors 601 (NM1) and 602 (NM2) drive dual mode antenna 307. The passive transistors 603 (NM3) and 604 (NM4) of immobilizer driver 305 are configured to remain off even if the signal from LF mode operation is present at common node 306.

A problem with the circuit configuration of FIG. 6 is that the parasitic diodes $D_{DB}$, $D_{SB}$ for transistors 603, 604 may become forward biased due to the signal present at common node 306, resulting in unintended currents through immobilizer driver 304. This problem is avoided by keeping the condition VTX=VDS during LF mode operation. This voltage condition keeps the parasitic diodes $D_{DB}$, $D_{SB}$ for transistors 603, 604 in reverse bias condition.

Figure 7:
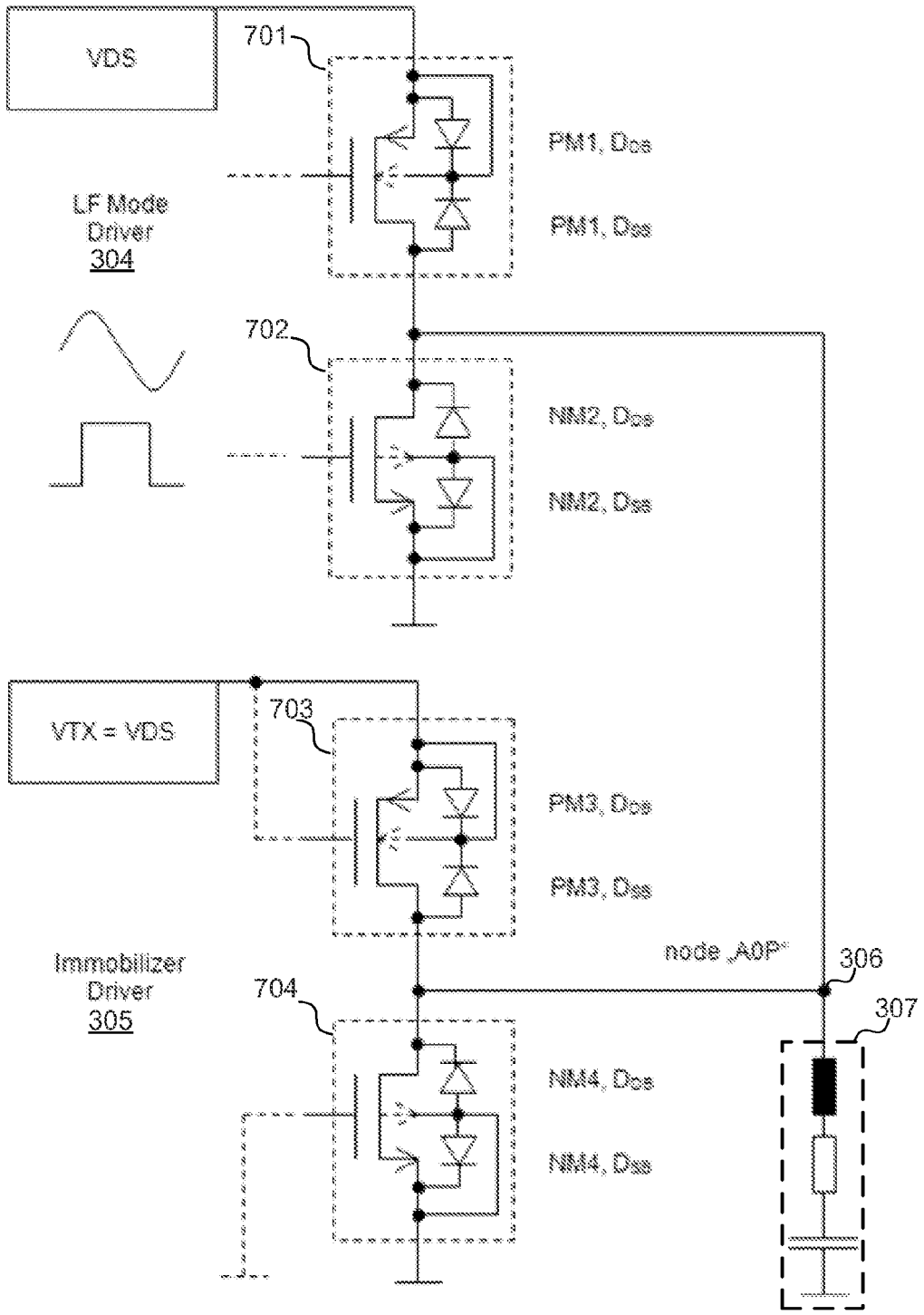
FIG. 7 illustrates an example circuit configuration for LF mode using push-pull components.

In some implementations, push-pull driver circuits may be used by replacing NMOS transistors 601, 603 with PMOS transistors 701 (PM1), 703 (PM3), as shown in FIG. 7.

Figure 8:
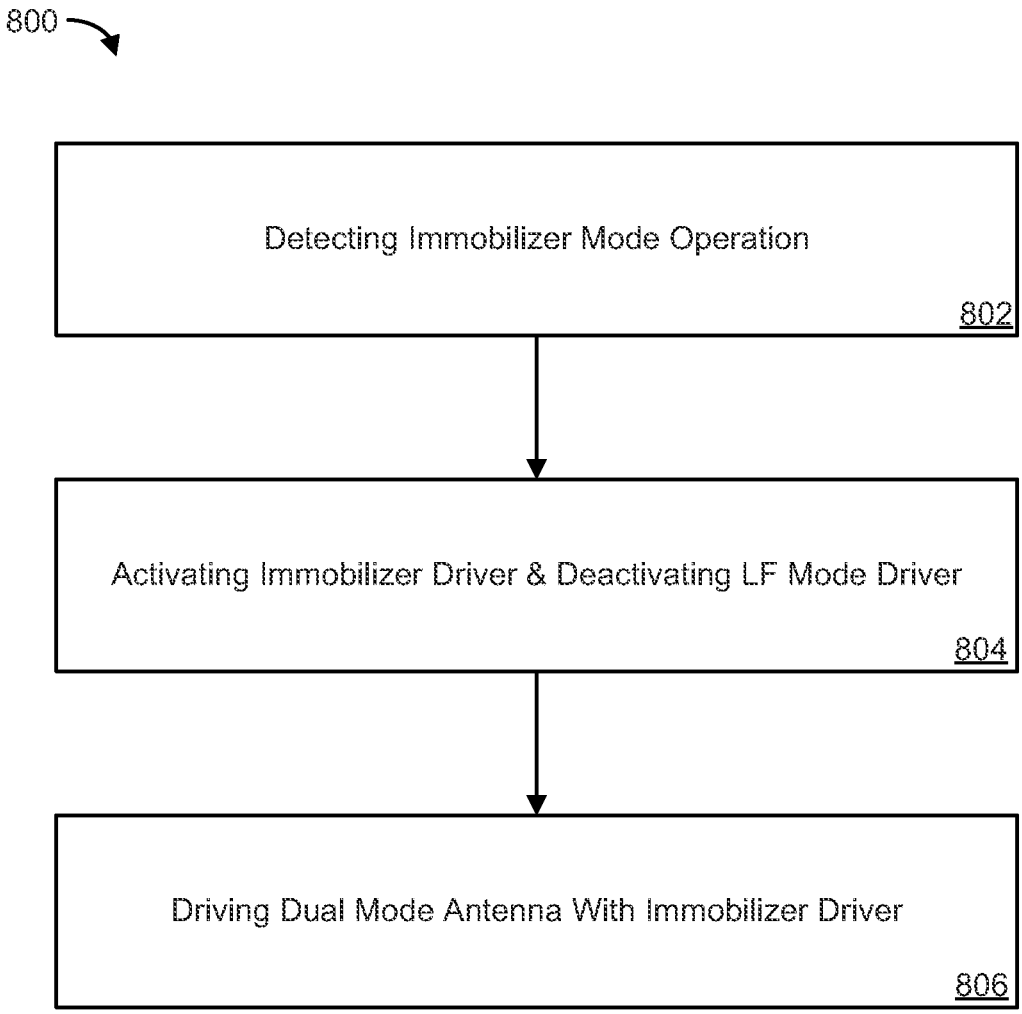
FIG. 8 is a flow diagram illustrating an example process performed during immobilizer mode.

FIG. 8 is a flow diagram illustrating an example process 800 performed by system 300 while operating in immobilizer mode of operation. In some implementations, process 800 detects an immobilizer mode operation (802), activates an immobilizer driver, deactivates an LF mode driver (804) and drives a dual mode antenna with the immobilizer driver (806). The immobilizer driver and LF mode driver have outputs coupled to a common node, which is coupled to the dual mode antenna. During immobilizing mode of operation, parasitic diodes of the transistors in the LF mode driver are reverse biased to prevent currents from entering the LF mode driver due to a signal present at the common node due to operation of the immobilizer driver.

Figure 9:
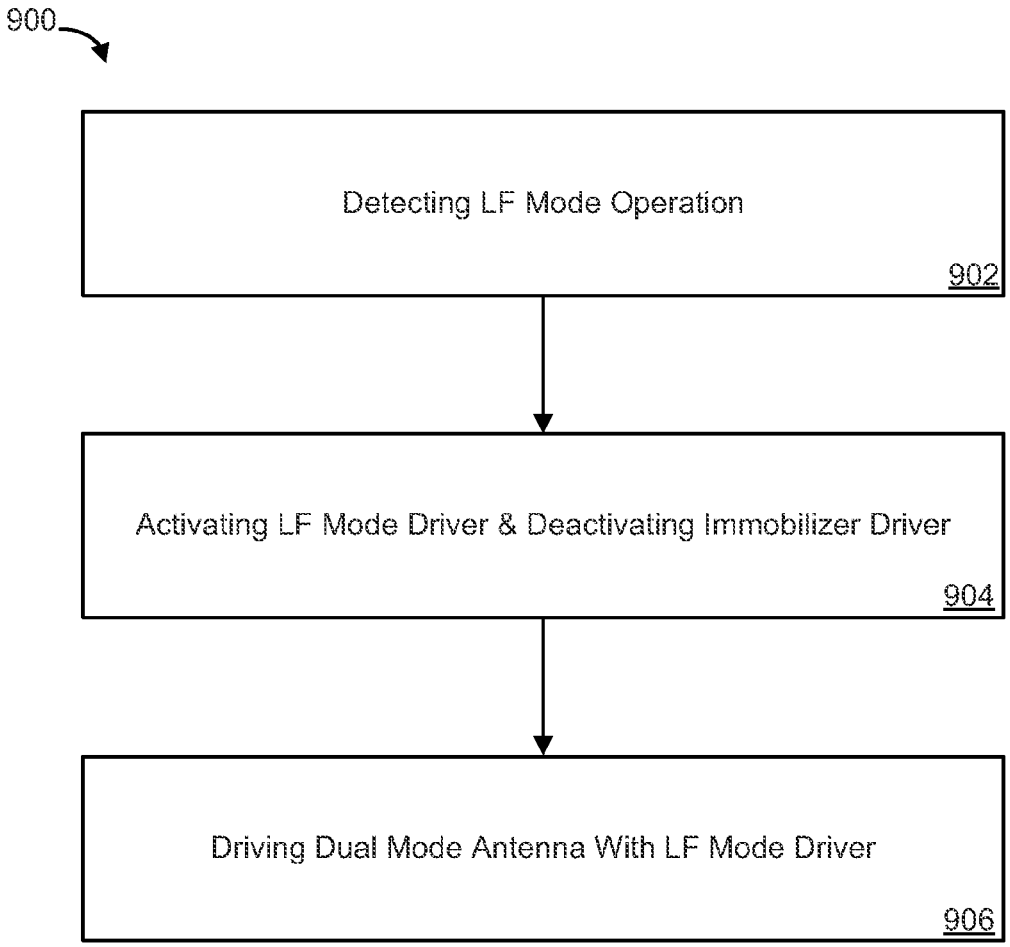
FIG. 9 is a flow diagram illustrating an example process performed during LF mode.

FIG. 9 is a flow diagram illustrating an example process 900 performed while operating in the LF mode of operation. In some implementations, process 900 detects an LF mode operation (902), activates an LF mode driver, and deactivates an immobilizer driver (904) and drives a dual mode antenna with the LF mode driver (806). The immobilizer driver and LF mode driver have outputs coupled to a common node, which is coupled to the dual mode antenna. During LF mode operation, parasitic diodes of the transistors in the immobilizer driver are reverse biased to prevent currents from entering the immobilizer driver due to a signal present at the common node due to operation of the LF mode driver.

While this document contains many specific implementation details, these should not be construed as limitations on the scope what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A circuit comprising:

a first driver having an input coupled to a supply voltage VDS and an output coupled to a common node, the first driver configured to drive a first signal at the common node during a first mode of operation, the first driver configured to reverse bias a first set of parasitic diodes of a first set of transistors of the first driver to prevent a current present at the common node from entering the first driver due to a second signal being present at the common node due to operation of a second driver during a second mode of operation;

a regulator coupled to the supply voltage VDS and configured to output a regulated supply voltage VTX during the second mode of operation; and the second driver coupled in parallel with the first driver, the second driver having an input coupled to the regulator output and having an output coupled to the common node, the second driver configured to receive the voltage supply VDS during the first mode of operation and to receive the regulated supply voltage VTX during the second mode of operation, the second driver configured to drive the second signal at the common node during the second mode of operation, the second driver configured to reverse bias a second set of parasitic diodes of a second set of transistors of the second driver to prevent the current from entering the second driver due to the first signal being present at the common node due to operation of the first driver during the first mode of operation.

2. The circuit of claim 1 where during the first mode of operation VTX equals VDS.

3. The circuit of claim 1, where during the second mode of operation VD S is greater or equal to VTX.

4. The circuit of claim 1, where the regulator is bypassed during the first mode of operation.

5. The circuit of claim 1, where during the first mode of operation the output of the second driver is kept in an ohmic state high enough to prevent leakage current from entering the second driver due to the first signal.

6. The circuit of claim 1, where during the second mode of operation the output of the first driver is kept in an ohmic state high enough to prevent leakage current from entering the first driver due to the second signal.

7. The circuit of claim 1, where the circuit is included in an integrated circuit chip installed in a vehicle.

8. The circuit of claim 1, further comprising:

a booster coupled to a voltage supply and configured to output an unregulated supply voltage VDS that is higher than the voltage supply.

9. The circuit of claim 1, further comprising:

a booster coupled to a voltage supply and configured to output a regulated supply voltage VDS that is higher than the voltage supply.

10. The circuit of claim 1, where the circuit is configured for differential signals.

11. A method comprising:

providing a supply voltage VDS to a first driver having an output coupled to a common node, where VDS is higher than a voltage supply, the first driver configured to reverse bias a first set of parasitic diodes of a first set of transistors of the first driver to prevent a current present at the common node from entering the first driver due to a second signal being present at the common node due to operation of a second driver during a second mode of operation;

detecting a first mode of operation;

driving a first signal at the common node with the first driver during the first mode of operation;

detecting the second mode of operation;

providing a regulated supply voltage VTX to the second driver coupled in parallel to the first driver and having an output coupled to the common node; and driving the second signal at the common node with the second driver, the second driver configured to reverse bias a second set of parasitic diodes of a second set of transistors of the second driver to prevent the current from entering the second driver due to the first signal being present at the common node due to operation of the first driver during the first mode of operation.

12. The method of claim 11, where during the first mode of operation VTX equals VDS.

13. The method of claim 11, where during the second mode of operation VDS is greater or equal to VTX.

14. The method of claim 11, where the regulated supply voltage VTX is bypassed during the first mode of operation.

15. The method of claim 11, where during the first mode of operation the output of the second driver is kept in an ohmic state high enough to prevent leakage current from entering the second driver due to the first signal.

16. The method of claim 11, where during the second mode of operation the output of the first driver is kept in an ohmic state high enough to prevent leakage current from entering the first driver due to the second signal.

17. The method of claim 11, further comprising regulating the supply voltage VDS.

18. A system comprising:

a dual mode antenna coupled to a common node;

a first driver having an input coupled to a supply voltage VDS and an output coupled to the common node, the first driver configured to drive the dual mode antenna during a first mode of operation, the first driver configured to reverse bias a first set of parasitic diodes of a first set of transistors of the first driver to prevent a current present at the common node from entering the first driver due to a second signal being present at the common node due to operation of a second driver during a second mode of operation;

a regulator coupled to the supply voltage VDS and configured to output a regulated supply voltage VTX during the second mode of operation; and the second driver coupled in parallel with the first driver, the second driver having an input coupled to the regulator output and having an output coupled to the common node, the second driver configured to receive the voltage supply VDS during the first mode of operation and to receive the regulated supply voltage VTX during the second mode of operation, the second driver configured to drive the dual mode antenna during the second mode of operation, the second driver configured to reverse bias a second set of parasitic diodes of a second set of transistors of the second driver to prevent the current from entering the second driver due to the first signal being present at the common node due to operation of the first driver during the first mode of operation.

19. The system of claim 18, where during the first mode of operation VTX equals VDS.

20. The system of claim 18, where during the second mode of operation VDS is greater or equal to VTX.

* * * * *